United States Patent [19]

Marchetti

[11] Patent Number: 4,722,165

[45] Date of Patent: Feb. 2, 1988

[54] SELF-ADJUSTING CLOSING MACHINE FOR PARALLELEPIPEDAL BOXES OF VARYING FORMAT

[76] Inventor: Augusto Marchetti, Piazza Sicilia, 7 - 20146 Milano, Italy

[21] Appl. No.: 3,264

[22] Filed: Jan. 14, 1987

[30] Foreign Application Priority Data

Jan. 20, 1986 [IT] Italy ..... 19119 A/86
Jul. 15, 1986 [IT] Italy ..... 21127 A/86

[51] Int. Cl.[4] ..... B65B 57/00
[52] U.S. Cl. ..... 53/76; 53/374
[58] Field of Search ..... 53/374, 76, 75, 69, 53/375, 491, 504; 493/25

[56] References Cited

U.S. PATENT DOCUMENTS 3,775,937 12/1973 Devan et al. ..... 53/374 X
3,885,372 5/1975 Peres ..... 53/374 X
3,894,380 7/1975 Poulsen ..... 53/374 X
4,041,675 8/1977 Loveland et al. ..... 53/374 X
4,218,862 8/1980 Marchetti ..... 53/374
4,317,319 3/1982 Price ..... 53/374 X

*Primary Examiner*—James F. Coan
*Attorney, Agent, or Firm*—Cushman, Darby & Cushman

[57] ABSTRACT

A detecting member for the height of the box with open side flaps is mounted in a vertically variable position on the closing assembly for the top flaps and is connected mechanically to the drive device which draws together the box conveyance units. In this manner drawing together of the conveyance units until they engage the sides of the box causes a corresponding movement of the detecting member which arranges itself in a position dependent upon the width of the box. Fall of the closing assembly starts simultaneously from a raised neutral position and continues until engagement of the detecting member so arranged with the top of an open side flap of the box. Braking means then stop the fall of the closing assembly. Appropriate sensitive means start operation of the closing assembly for the rear flap on the basis of the box length.

14 Claims, 16 Drawing Figures

SELF-ADJUSTING CLOSING MACHINE FOR PARALLELEPIPEDAL BOXES OF VARYING FORMAT

Figure 1:
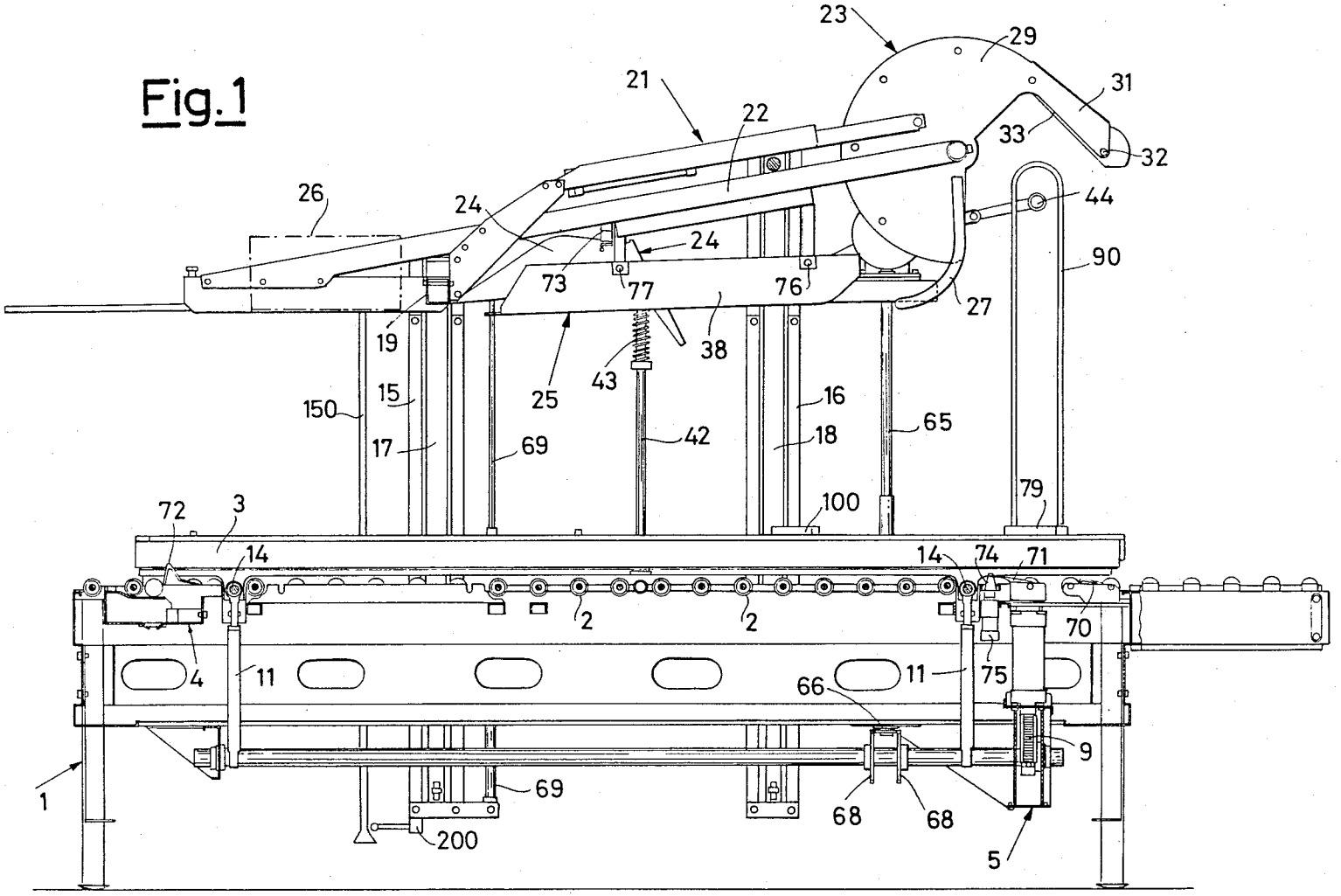

The present invention relates to a self-adjusting closing machine for parallelepiped boxes of varying format.

A known packing system calls for the use of parallelepiped cardboard boxes which after filling are closed at the top by means of folding flaps sealed with strips of adhesive tape. More precisely, said boxes comprise a front flap and a rear flap folding first and two side flaps folding thereafter without mutual superimposition. Between the two folded side flaps there is described a narrow longitudinal separating fissure arranged centrally along which there is finally applied from one end to the other of the box the strip of sealing adhesive tape.

Various machines are known for automatic closing in succession of the top flaps of boxes having a fixed format. They only require an initial adjustment based on the width and height of the box and then are ready to operate repetitively on a plurality of boxes of the same format.

Problems arise when the boxes are of varying format since it is not practicable to regulate the machine for each box fed.

Socalled "self-adjusting" machines are known which through appropriate members measure the width and height of the boxes and on the basis thereof automatically vary the position of the closing members.

Some of these are based on the concept that the height of the open side flaps of the box is equal to half the width of the box so that by measuring said width and the total height of the box with side flaps open and substracting the first result from the second it is possible to find the height of the box with closed flaps and hence the vertical position required for the closing members.

Said concept is undoubtedly valid but the machines obtained have proved rather complicated and/or inaccurate so that they have met with little practical application.

The object of the present invention is to achieve a closing machine for parallelepiped boxes of varying format which in a simple and functional manner would be capable of taking the dimensions of the box and automatically adapting thereto the position of the closing members.

In accordance with the invention said object has been achieved by a self-adjusting closing machine comprising a supporting table for the boxes, a pair of belt conveying units extending along opposing sides of said supporting table, means for drawing together said conveying units until the corresponding opposing sides of the boxes are engaged thereby, a closing assembly for the top flaps of the boxes which may be arranged at variable height above said supporting table and adjusting means for automatically regulating said variable height of the closing assembly based on the format of the boxes characterized in that said adjusting means comprises a member for detecting the height of the boxes with side flaps open mounted in a vertically variable position on said closing assembly, means for modifying the vertical position of said detecting member in relation to a raised neutral position, a mechanical transmission placed between said means of drawing together the conveyance units and said means for modifying the vertical position of said detecting member in such a manner as to prearrange said detecting member in a lowered position at a distance from the base of said closing assembly equal to half of the width of the box, first sensitive means which respond to the engagement of said conveyance units with the sides of the box in such a manner as to control the free descent of said closing assembly from a raised neutral position to a maximum height above said supporting table, means for braking the descent of said closing assembly, second sensitive means which respond to the engagement of said detecting member with the top of an open side flap of the box and advancement of said conveyance assembly for further travel of the box, and third sensitive means which respond to said further travel of the box to control operation of said closing assembly for closing of the rear flap of the box.

This is essentially a machine which uses the known principle of substracting half the width of the box (equal to the height of an open side flap) from the total height of the box with side flaps open by initial setting of the total height detecting member in a position based on the width of the box. It is distinguished however from known machines which make use of said principle by the type of functional connection employed between the means for drawing the conveyance assembly together and the means for modifying the position of the detecting member as well as by the manner of moving and stopping the closing assembly. The use of a mechanical transmission with appropriately predetermined ratio allows reliable presetting of the detecting member precisely in the desired position with no possibility of error and with full repeatability. The free fall movement of the closing assembly and the employment of braking means constitute at the same time a very simple and accurate manner of correctly positioning the closing assembly.

Preferably the machine in accordance with the invention also requires that said third sensitive means comprise a first and a second sensitive element arranged along said supporting table in such a manner as to be met successively by the advancing box, said sensitive elements being operationally connected together and with said closing assembly in such a manner that operation of said closing assembly for closing of the rear flaps of the box is caused alternatively by abandonment of the first sensitive element if the box has already encountered the second sensitive element or by meeting with the second sensitive element if the first sensitive element has been abandoned before the box has met the second sensitive element.

In this manner the behaviour of the closing assembly and in general of the machine as a whole changes automatically with the length of the box. A long box when abandoning the first sensitive element while the second is still engaged by the same box causes operation of the closing assembly with the rear part of the box still to the rear while a short box, being linked to the encounter with the second sensitive element when the first sensitive element has already been abandoned, causes retarded operation of the closing assembly on the rear part of the advanced box so as to prevent interference between the closing of the rear flap and the closing of the front flap.

Preferably it is also provided that operation of the closing assembly be accompanied by a momentary stop of the box, i.e. with the box stationary instead of moving. This allows more reliable and accurate closing of the rear flap.

Figure 2:
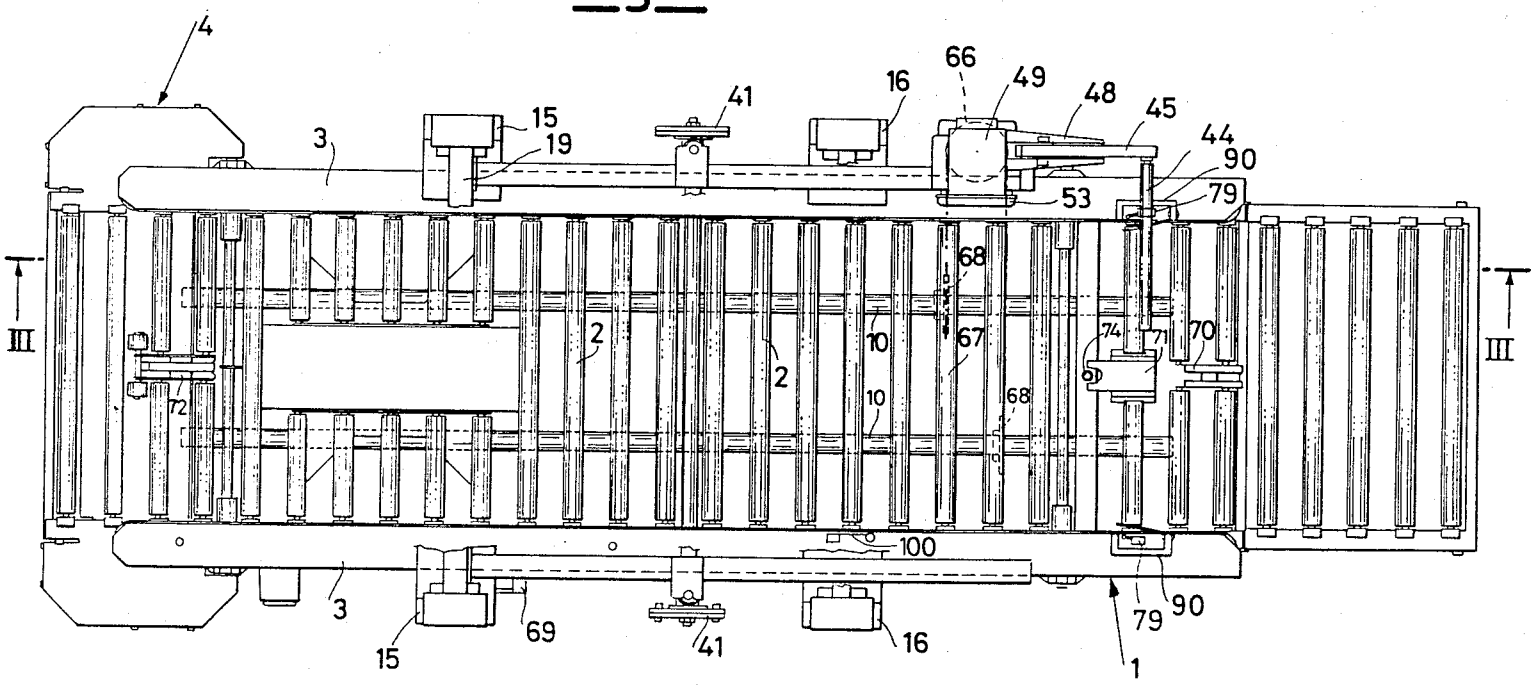
Figure 3:
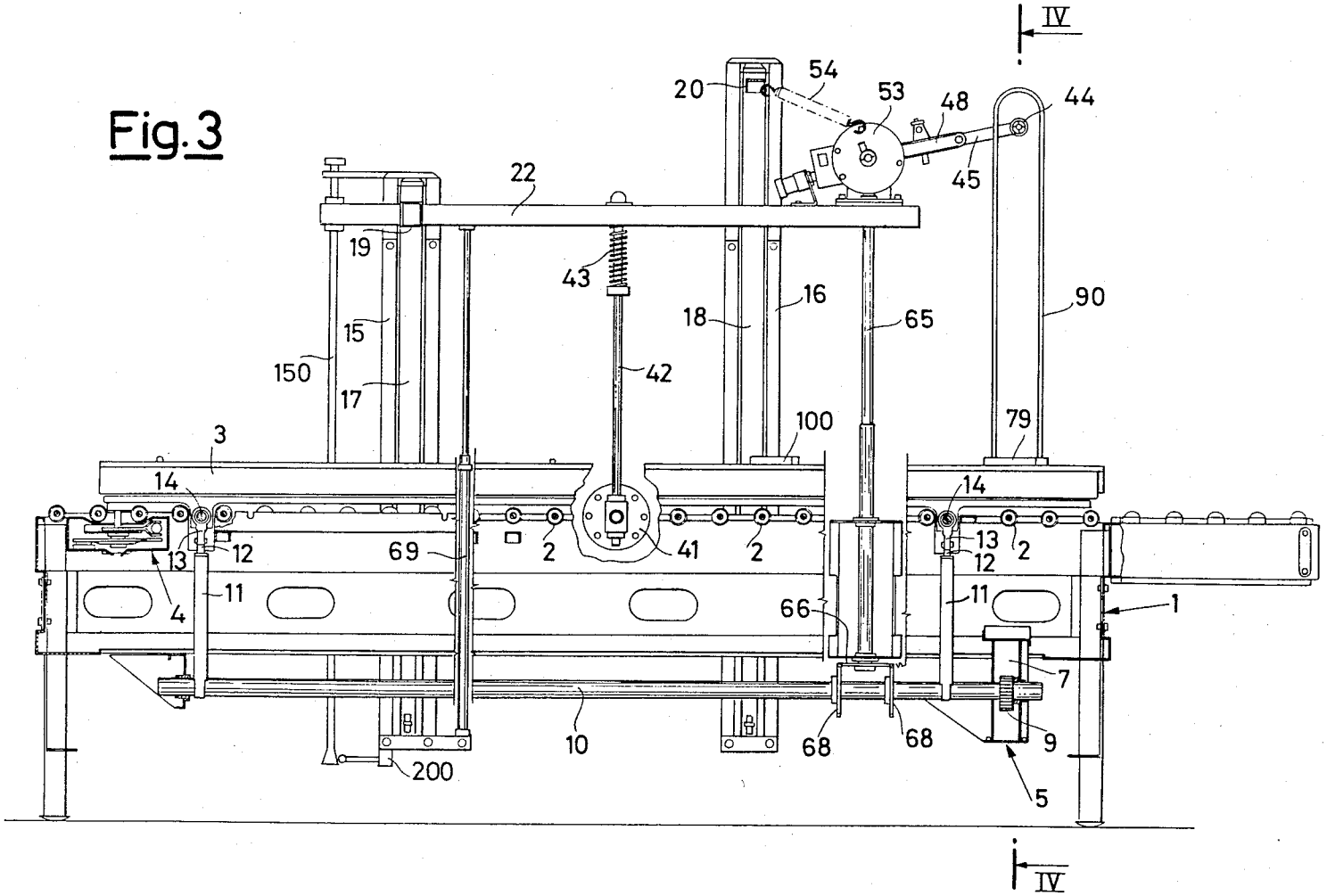
Figure 4:
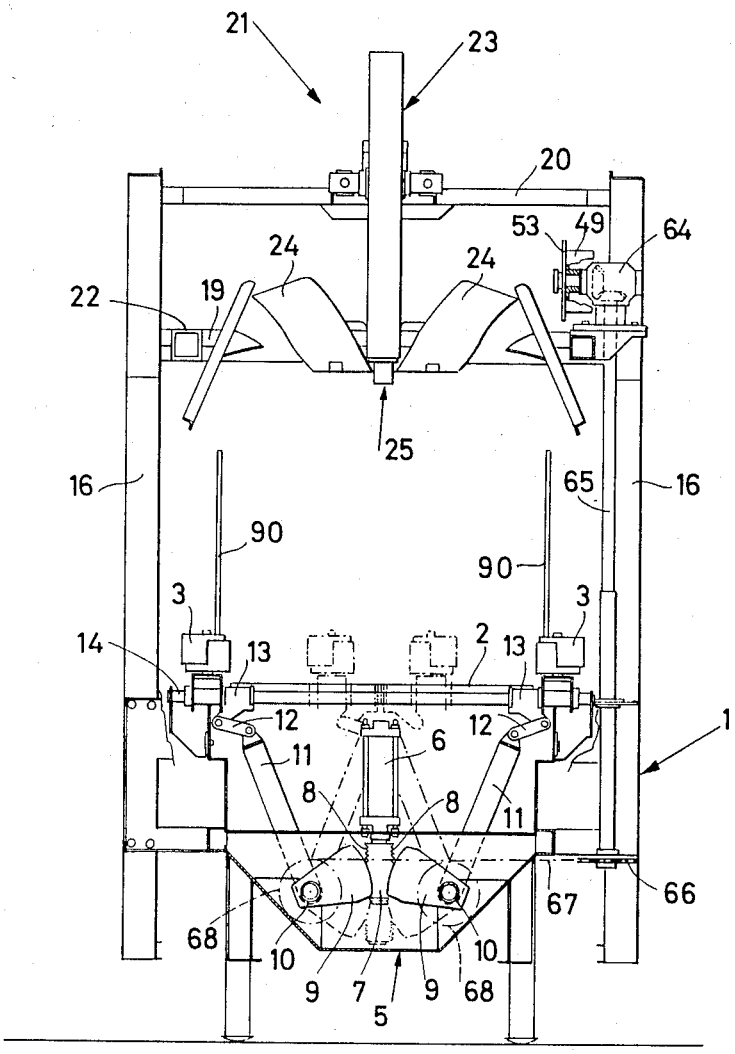
Figure 5:
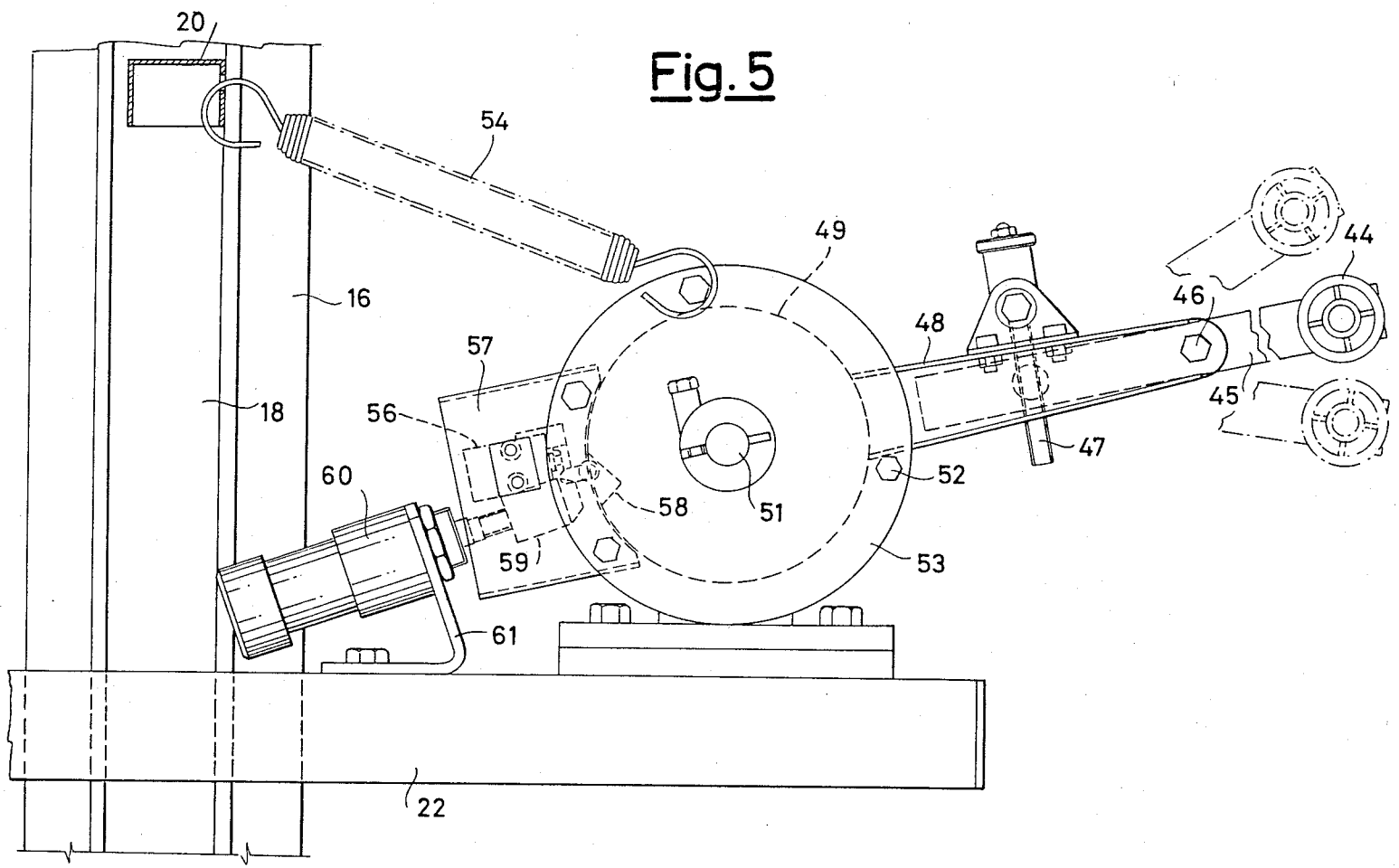
Figures 6, 7:
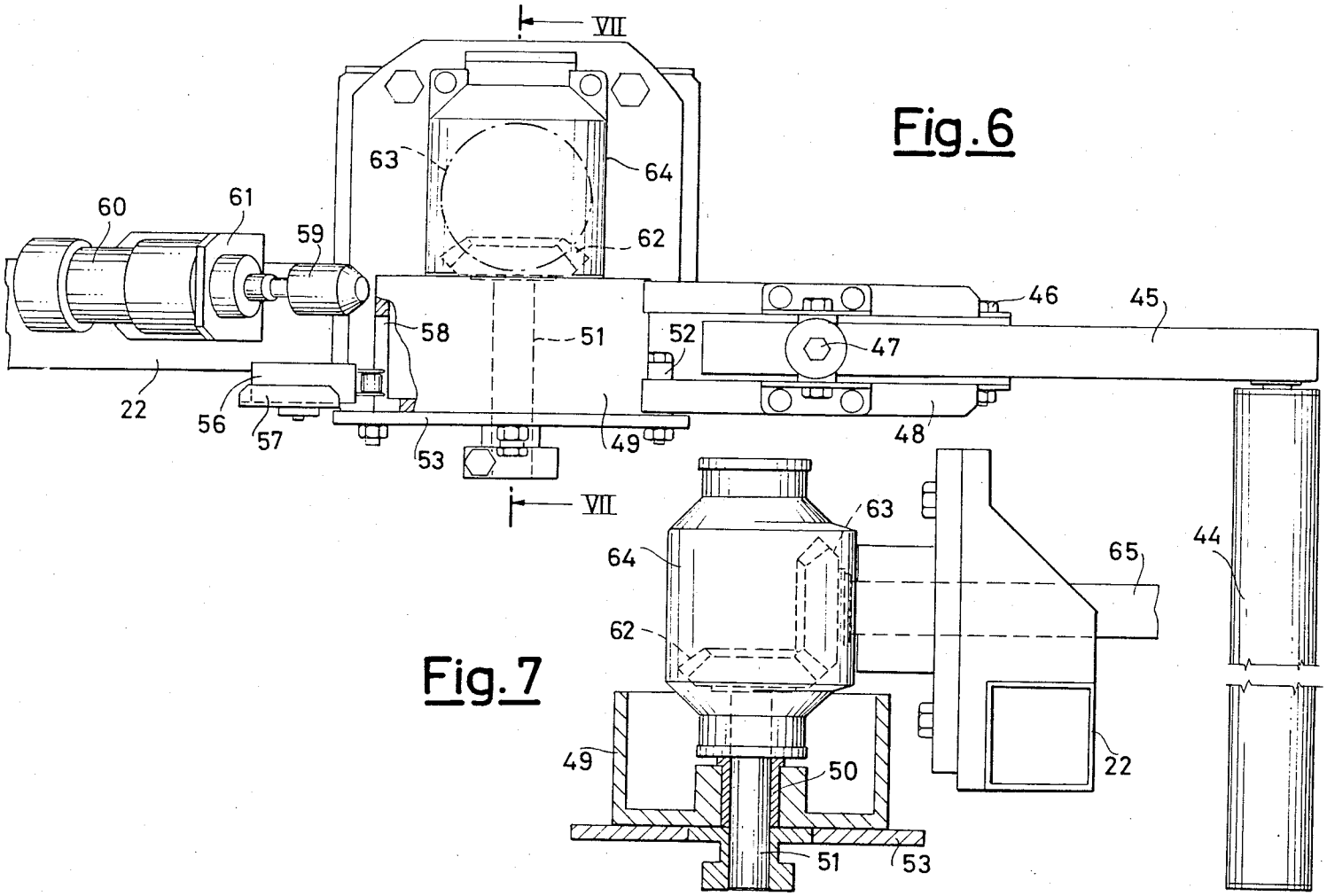
Figure 8:
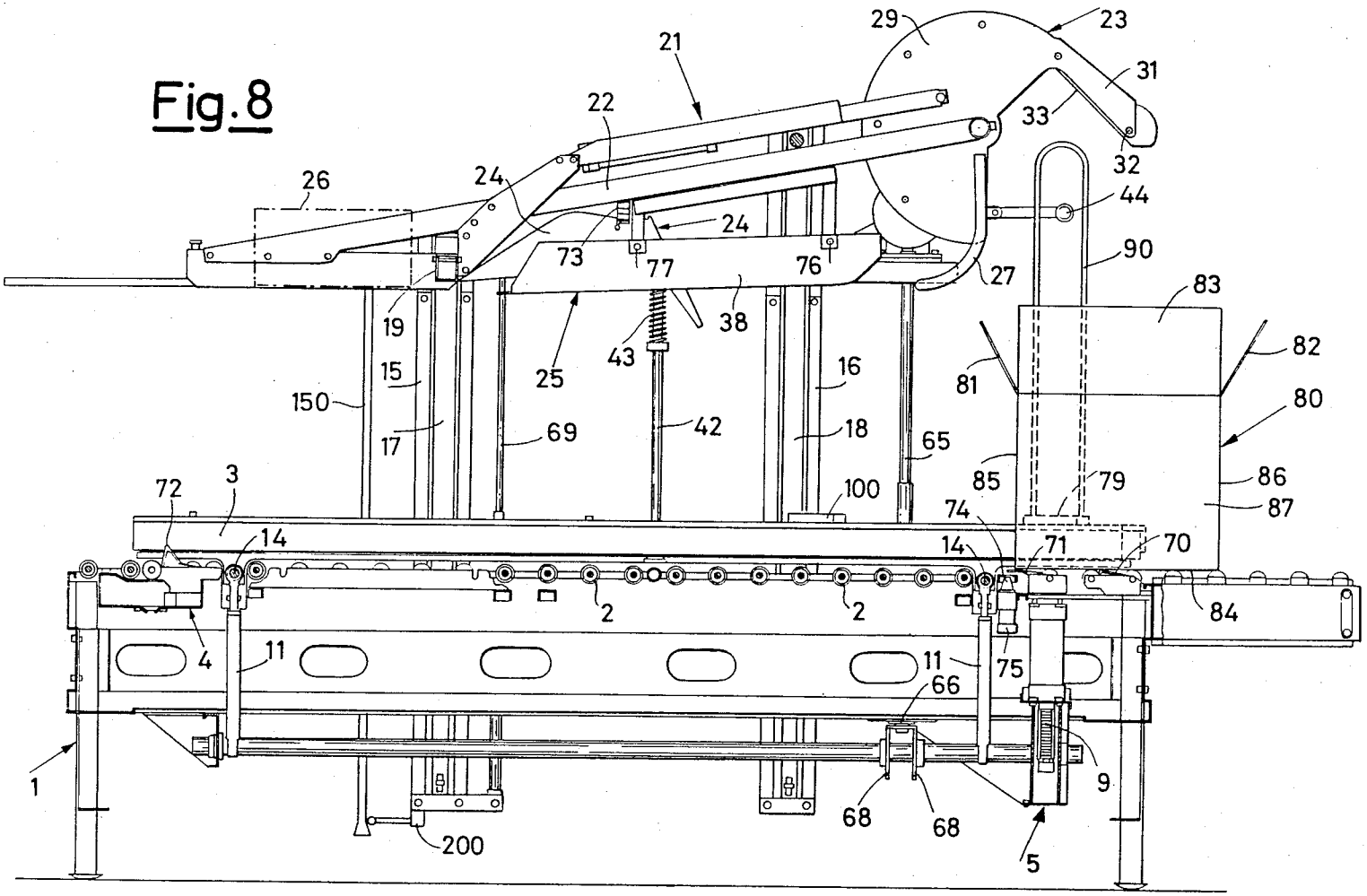
Figure 9:
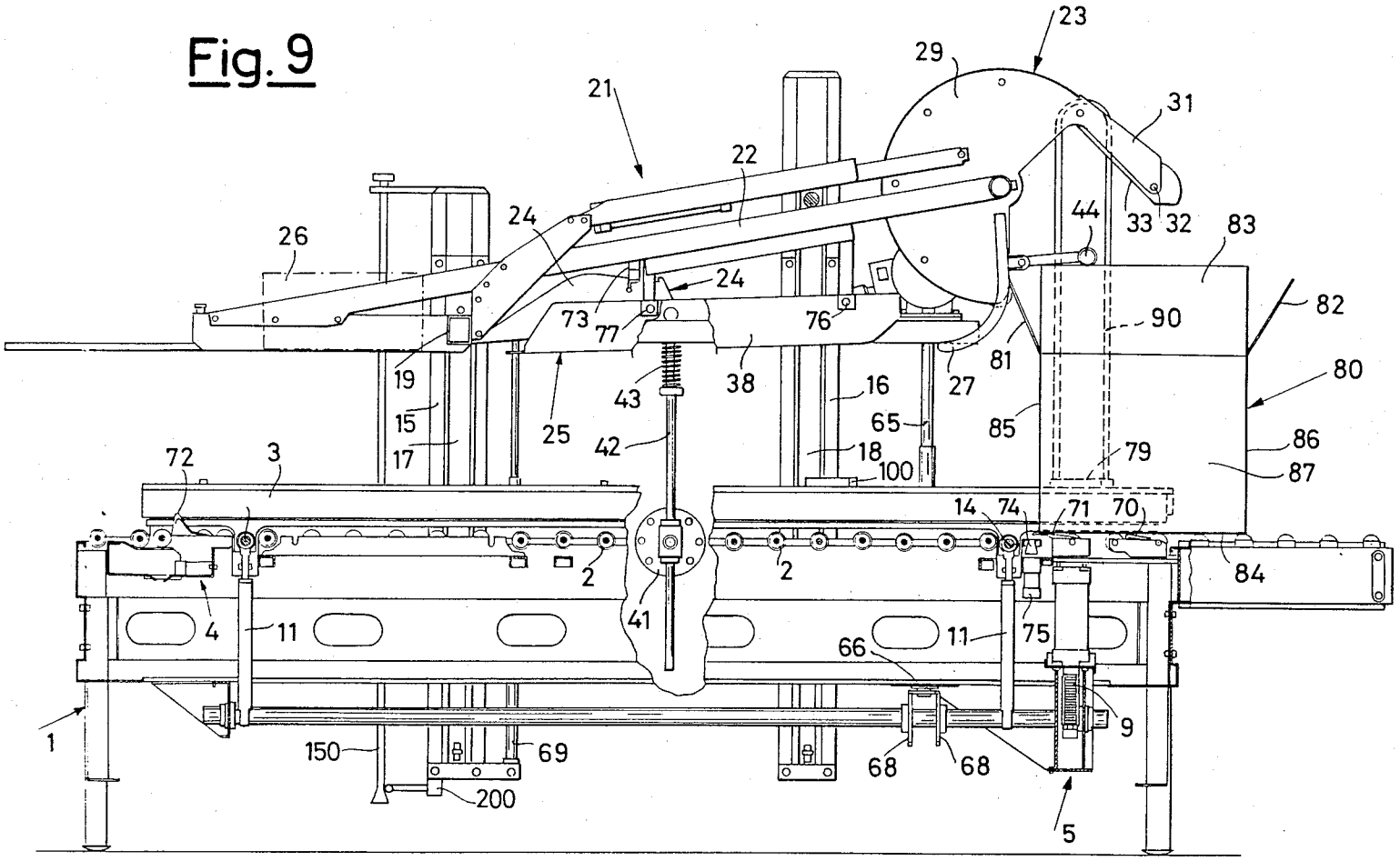
Figure 10:
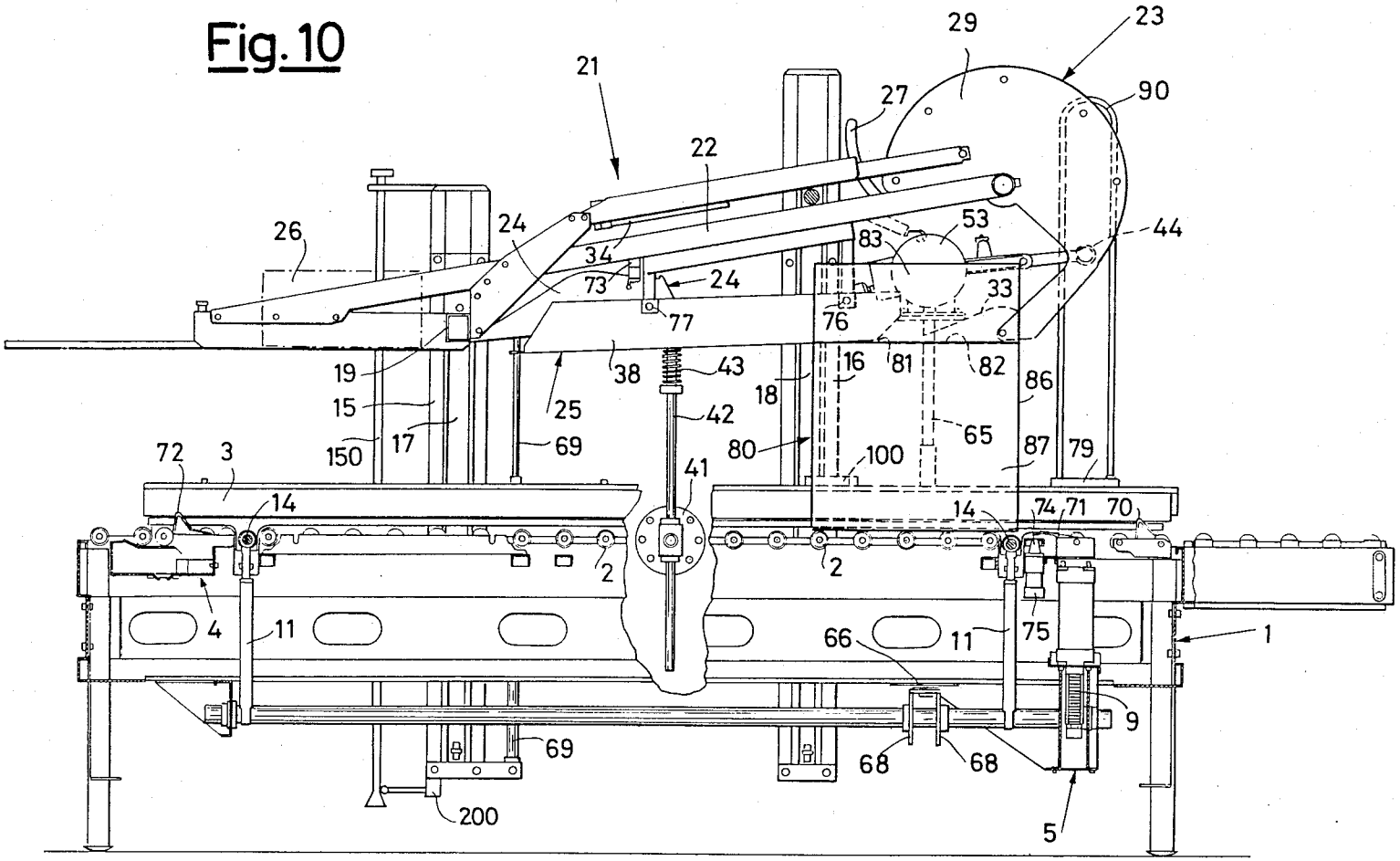
Figure 11:
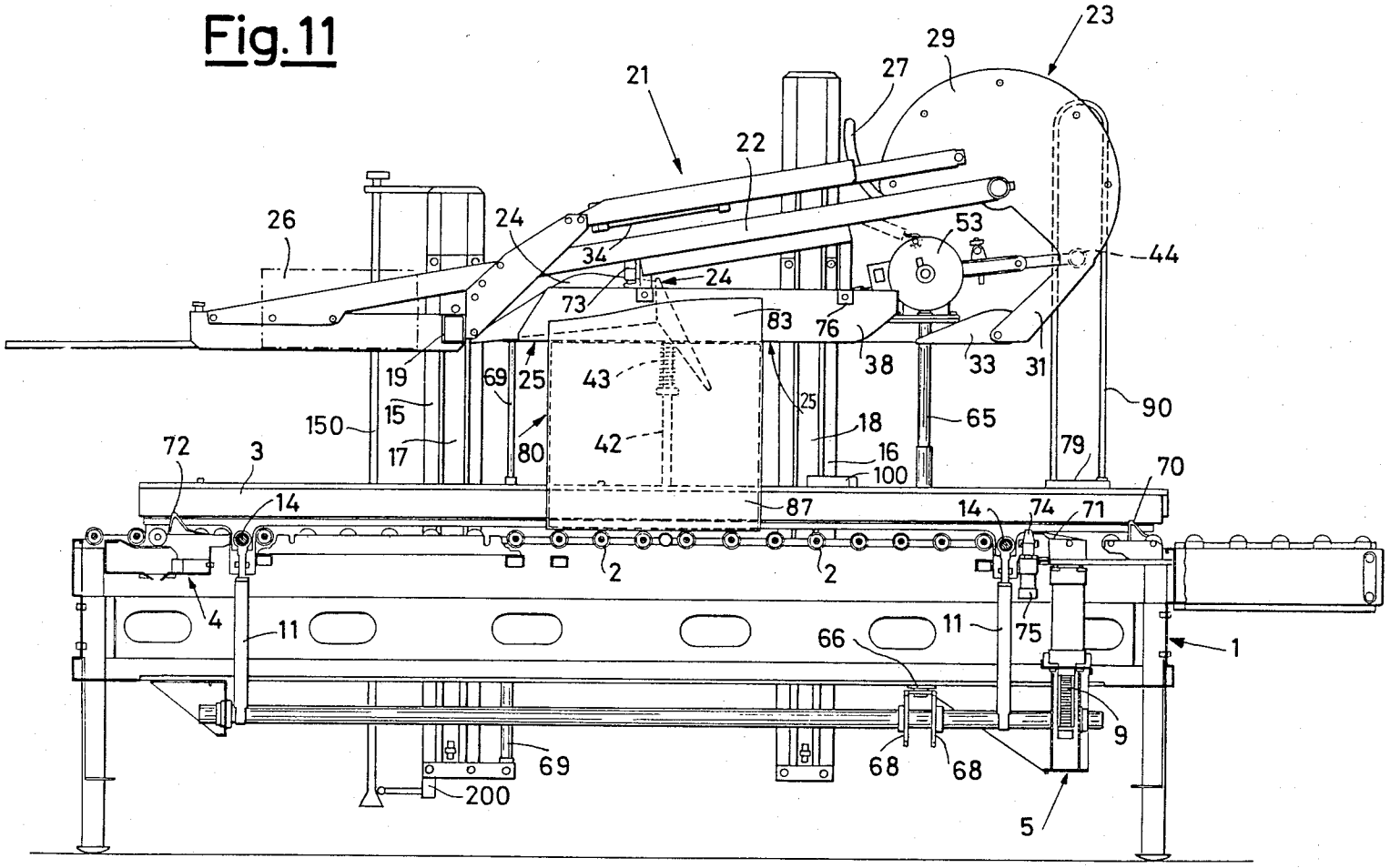
Figure 12:
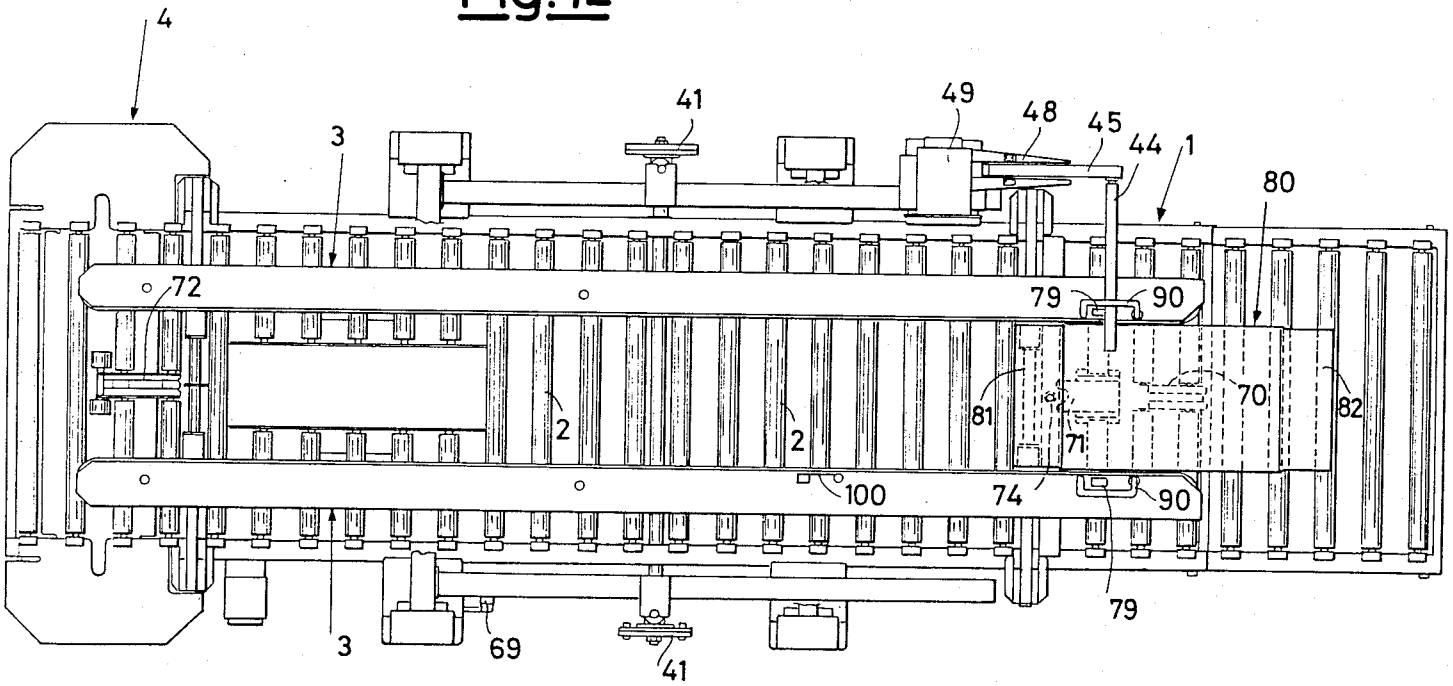
Figure 13:
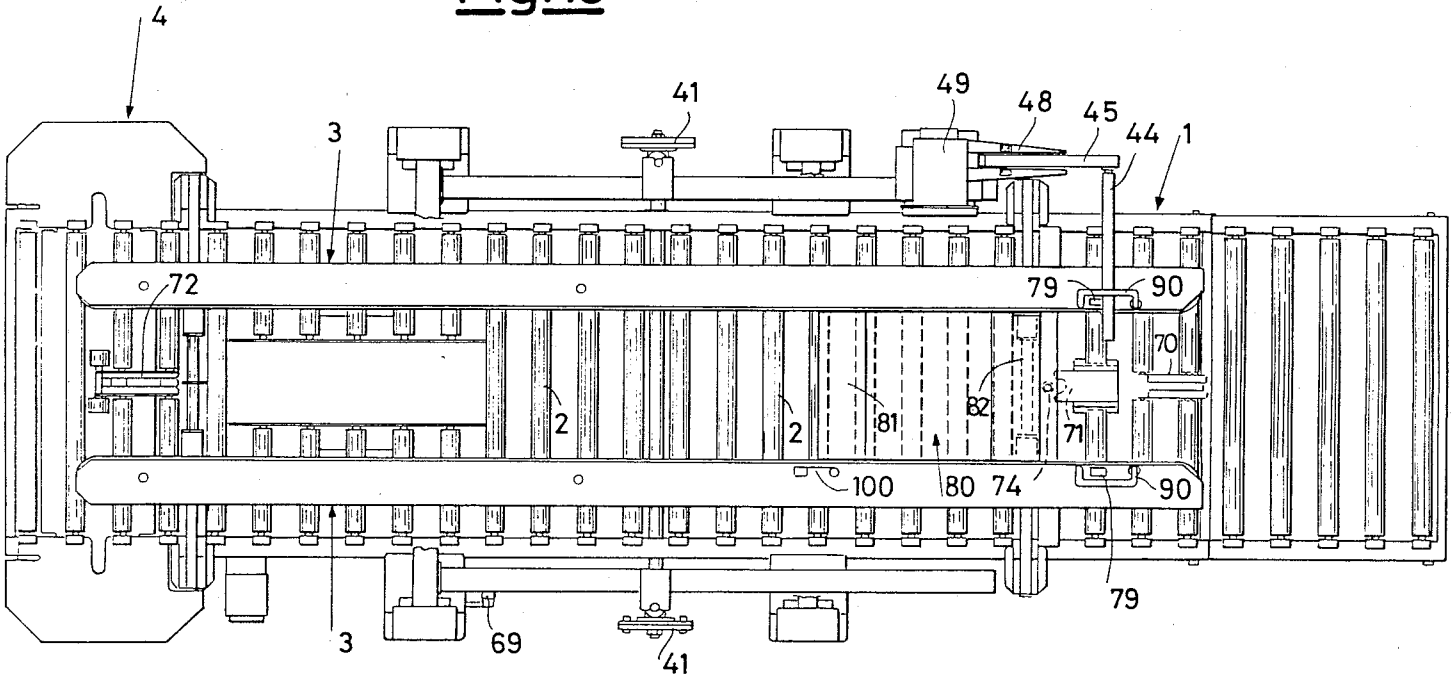
Figure 14:
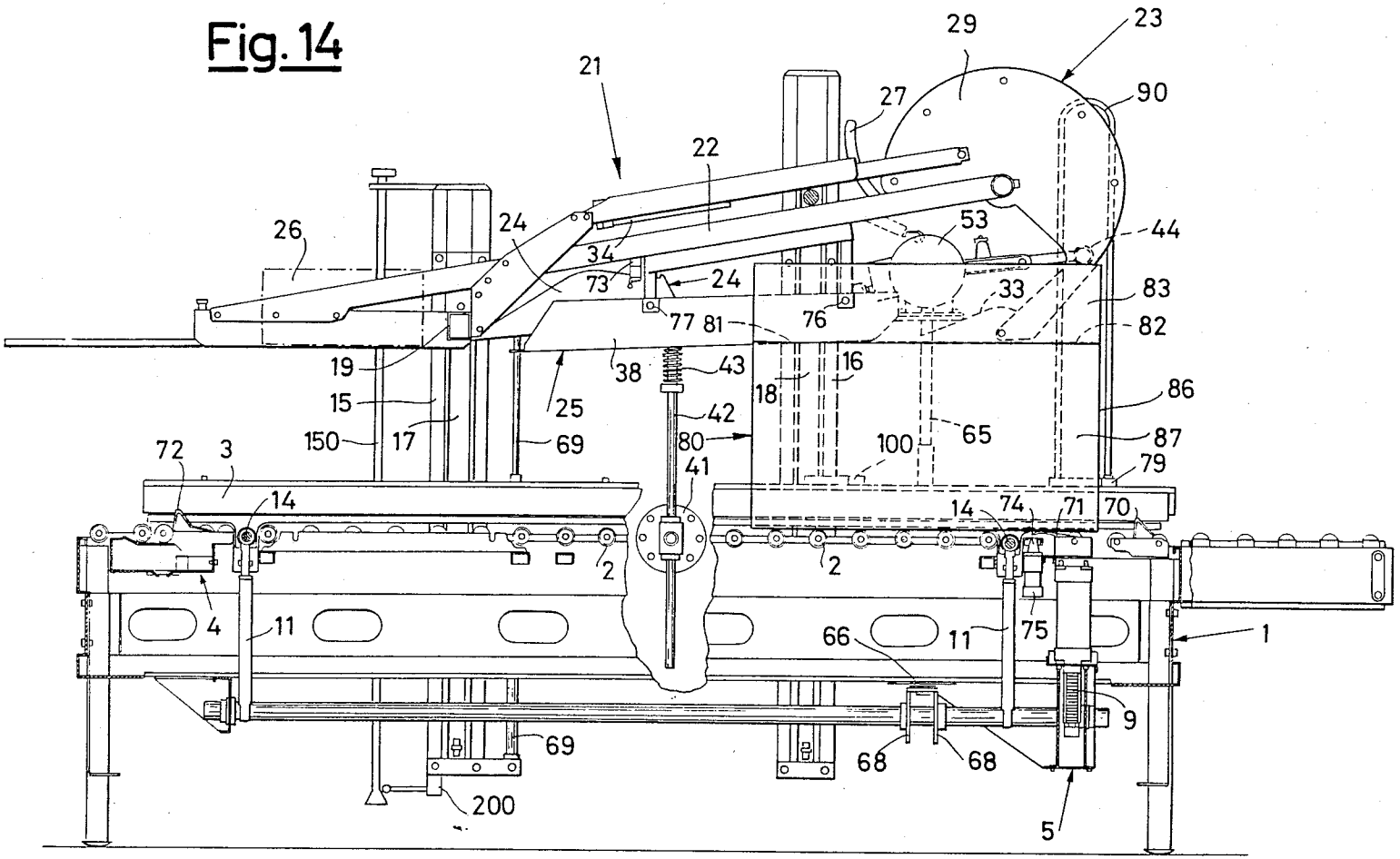
Figure 15:
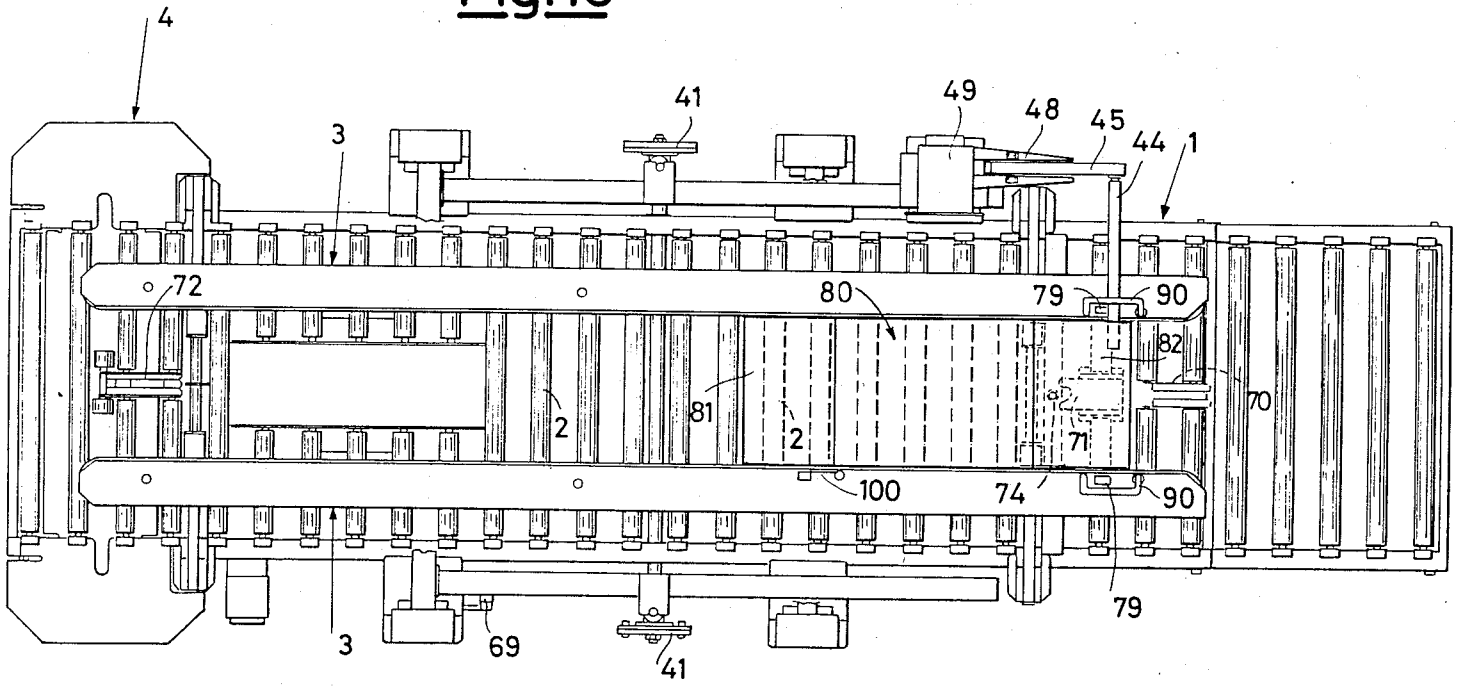
Figure 16:
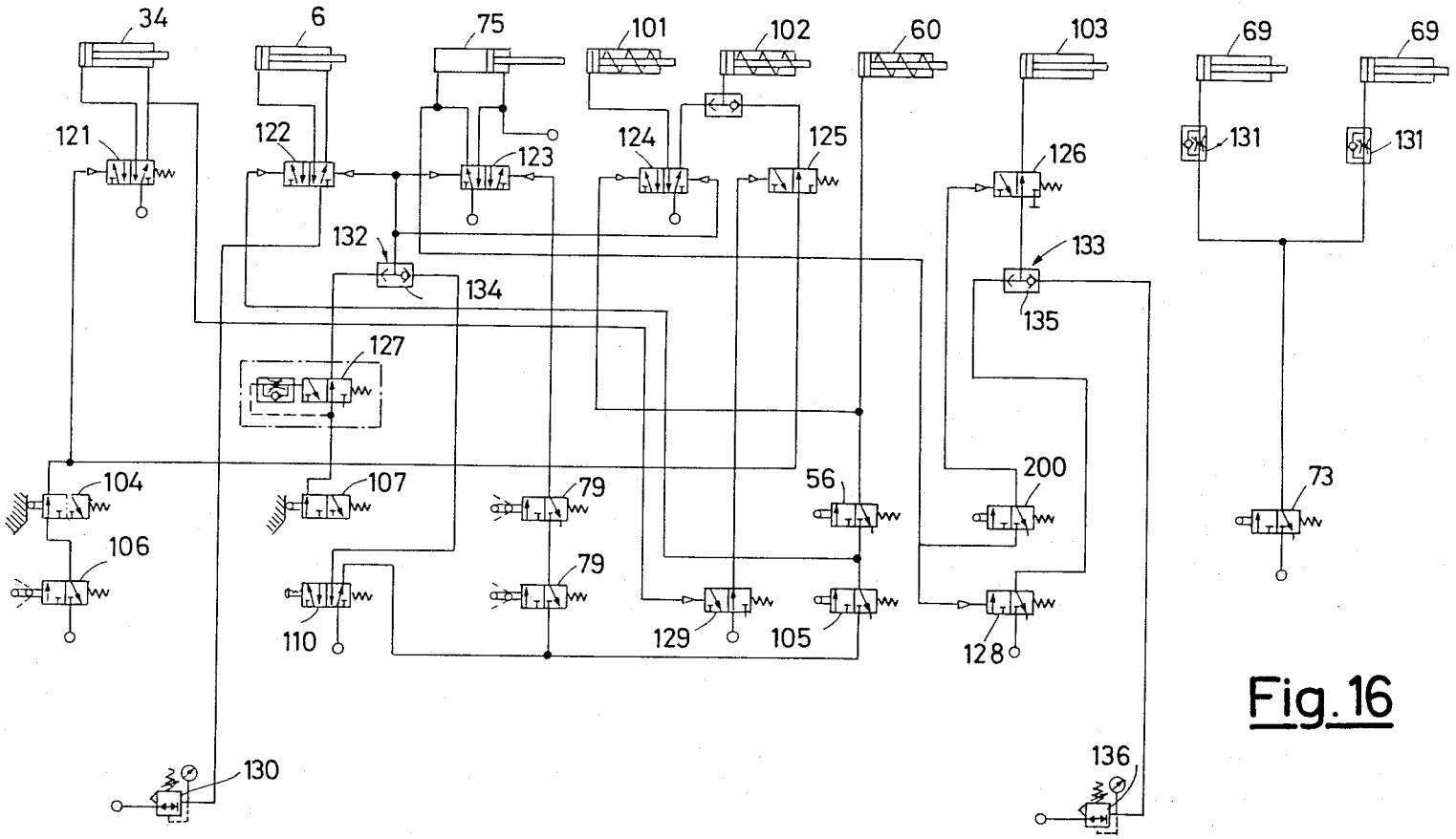

These and other characteristics of the present invention will be made evident by the following detailed description of a practical embodiment thereof illustrated as a nonlimiting example in the annexed drawings wherein:

FIG. 1 shows a longitudinal cross section of a machine in accordance with the invention in the neutral position, FIG. 2 shows a top view of the same machine without the closing assembly, FIG. 3 shows another longitudinal cross section of said machine passing through the line III—III of FIG. 2, FIG. 4 shows a cross section of the machine along line IV—IV of FIG. 3, FIG. 5 shows an elevation of the enlarged detail of the assembly comprising the detecting member of the total height of the box with open side flaps, FIG. 6 shows a top view of the assembly of FIG. 5, FIG. 7 shows a cross section along line VII—VII of FIG. 6 of the same assembly, FIGS. 8–11 show a longitudinal cross section of the machine as in FIG. 1 in successive operating positions when processing short boxes, FIGS. 12 and 13 show a top view of the machine as in FIG. 2 in the operating positions of FIGS. 9 and 10, FIGS. 14 and 15 show a longitudinal cross section and a top view of the machine during the operating phase of FIGS. 10 and 13 when processing long boxes, and FIG. 16 shows a diagram of the compressed air control system of the machine of the above figures.

The machine illustrated in the drawings comprises a bed 1 which supports a succession of parallel idling rollers 2 forming a supporting table for the boxes.

Along two opposite sides of said supporting table there extend two motor-driven belt conveyance units 3 (of known type) which are drawn together from a neutral position shown in unbroken lines in FIGS. 2 and 4 to the nearest position illustrated in dot and dash lines in FIG. 4 until they engage for conveyance the corresponding opposite sides of the box (FIGS. 12, 13 and 15).

Motor drive of the belts of the two conveyance units is provided by a motor assembly 4 of known type (FIG. 2) which allows drawing together and apart of said units. A clutch (not shown) of the type described in Italian patent application No. 19289 A/82 by the same applicant is placed between the motor 4 and the belts to allow momentary stopping of the belts when desired.

Drawing together and apart of the conveyance units 3 is due to a drive device 5 (FIGS. 3 and 4) also known which comprises essentially a drive cylinder 6, a sliding body 7 fixed to the stem of the drive cylinder 6 and equipped with opposing sides 8 shaped like a rack, a pair of sector gears 9 fixed on turning pins 10 and engaged with said opposite sides of the sliding body 7, two pairs of swinging arms 11 fixed to said pins 10, two pairs of connecting rods 12 and finally two pairs of slides 13 which slide on two guide bars 14 and bear at the two ends of the machine the conveyance units 3. For further details reference is made to Italian patent application No. 19288 A/82 filed Jan. 26, 1982 of which the same applicant is holder and the description of which is to be considered incorporated herein.

A pair of pneumatic valves 79 (FIG. 3) is associated with the conveyance unit 3 to detect engagement thereof with the sides of the boxes.

From the same sides of the bed 1 there extend upward two pairs of columns 15 and 16 which act as sliding guides for corresponding vertical slides 17 and 18 (FIGS. 1, 2 and 4) which extend downward from a pair of integral crosspieces 19 and 20 which form part of a closing assembly 21 for the top flaps of the boxes which is placed above the box-supporting table at a variable height in the manner described below.

The closing assembly 21 comprises a supporting frame 22 which includes the two crosspieces 19 and 20 and supports a closing device for the end flaps 23 (FIG. 1), a pair of closing screws for the side flaps 24 (FIG. 4), a flap holder 25 and a taping unit 26 (shown only schematically in FIG. 1).

The device for closing the end flaps 23 is of the type described in Italian patent application No. 21011 B /85 filed Mar. 6, 1985 of which the same applicant is the holder and comprises essentially a first closing member 27 for the front flap (in the direction of travel of the box from right to left as seen in FIG. 1) and a second closing member 28 for the rear flap, associated with a single rotating support 29 made in the form of a boxed disc extending for substantially three-fourths of a circle and pivoted at 30 on one end of the supporting frame 22. The closing member for the front flap 27 consists of a pair of curved bars born by one end of the rotating support 29 while the rear-flap closing member 28 consists of an extension 31 of the rotating support 29 on which is pivoted at 32 a blade 33 on which a spring and a flexible strip of fixed length (neither shown) act in such a manner as to hold it within the space occupied by the extension 31 when the rotating support 29 is in the neutral position of FIG. 1 and force it instead to rotate and emerge from said space occupied to the working position of FIG. 10 in reaction to the rotation of the rotating support 29 from the position of FIG. 1 to that of FIG. 10. For better understanding of the device 23 reference is made to the aforesaid patent application the description of which is to be considered incorporated herein.

To rotate the disc support 29 there is provided a compressed air cylinder 34 which reacts between a pair of brackets 35 fixed to the crosspiece 19 and a pair of straight rods 36 pivoted at excentric points 37 of the sides of the rotating support 29.

The two side-flap closing screws 24 are of the type described in Italian patent application No. 19788 A/85 filed Mar. 6, 1985 the holder of which is the same applicant and the description of which is to be considered incorporated herein. It is important to note that in conformity with the aforesaid patent application the two screws are shaped in such a manner as to permit closing of the side flaps of boxes of different widths with no need of side adjustment.

The flap holding device 25 which constitutes the lower base of the closing assembly 21 is also well known in the art and comprises a longitudinal overturned-T section attached to the overstanding supporting frame 22 by means of two parallel rods 39 and 40 which support it in a slightly inclined position (higher at the box inlet end and lower at the outlet end) as shown in FIG. 1. The rods 39 and 40 are affixed rigidly to the overstanding frame 22 while a pin 76 in a cylindrical hole and a pin 77 in a vertically lengthened slot 78 connect in an articulated manner said rods 39 and 40 to the section 38 in such a manner as to allow the entering box to partially or completely compensate for the inclination of the section 38. A compressed air valve 73 is fixed to the frame 22 to detect the lifting of the rear part of the section 38 to the horizontal position of said section.

The taping unit 26 is associated with the rear end of the supporting frame 22 beyond the crosspiece 19 and is for example the type illustrated in Italian patent application No. 23191 A/84 filed Oct. 17, 1984 of which the holder is the same applicant and the description is to be considered incorporated herein.

As mentioned above the closing assembly 21 is placed at a variable height above the box supporting table. Movement thereof is guided by cooperation of the slides 17 and 18 with the fixed columns 15 and 16 and is raised by compressed air cylinders (not shown) reacting between the lower ends of the slides 17 and 18 and the columns 15 and 16 and is lowered by the weight of the closing assembly. To stop the closing assembly 21 in any desired position in the course of its descent there is provided a pair of braking clamps 41 operated by compressed air (FIGS. 2 and 3) which cooperates with vertical rods 42 coupled in a sliding manner with the supporting 22 of the closing assembly 21 with interposed springs 43 to push the frame 22 back upward. Single-acting compressed air cylinders 69 with limited travel 69 (FIGS. 1 and 3) also act on the frame 22 to cause when required a limited and temporary rising of the frame 22 as will be better explained below.

To determine from time to time the correct vertical position of the closing assembly 21, which must be such that it places the flap-holding device 25 substantially even with the top of the box with end flaps closed to hold the latter in the closed position during the closing phase of the side flaps and until application of the sealing adhesive tape, there is provided a detecting device 44 for measurement of the total height of the box with open side flaps which cooperates with the drive device 5 for the drawing together motion of the conveyance unit 3 to subtract from said total height half of the box width which is equal to the height of the open side flaps.

As better shown in FIGS. 5–7 the aforesaid detecting member 44 consists of a cylindrical bar mounted in a freely turning manner on one end of a supporting arm 45 pivoted at 46 and further restrained in an adjustable manner by an adjusting screw 47 to a fork support 48 made integral with a drum 49 mounted in a turning manner through a bush 50 on a shaft 51. The weight of the fork support 48, of the arm 45 and of said detecting member 44 holds the entire described assembly in a predetermined angular position against a ratchet 52 fixed to a turning disc 53 made integral with the shaft 51 (FIG. 7) and fitted with a spring 54 attached to the crosspiece 20 to take up play. A compressed air valve 56 supported by a supporting bracket 57 fixed to the disc 53 (FIGS. 5 and 6) collaborates with a notch 58 in the drum 49 to detect movements of said drum and of the assembly fixed thereto relative to the angular position set by the screw 47. A blocking head 59 operated by a compressed air cylinder 60 fixed by a bracket 61 to the frame 22 (FIGS. 5 and 6) is in turn capable of pressing on the side wall of the drum 49 to prevent rotation thereof when necessary as will be explained better below. Alternatively the blocking head 59 may be replaced by a mechanical connection capable of acting on the drum 49 to slightly lift the detecting member 44 in relation to the predetermined position.

As shown in FIGS. 6 and 7 the shaft 51 is connected by a bevel gear pair 62 and 63 contained in a box 64 supported by the frame 22 to a vertical telescopic shaft 65 to the lower end of which is fixed a gear 66 (FIGS. 1–3) connected by a chain 67 to two gears 68 mounted on the connecting pins 10 which join the sector gears 9 to the swinging arms 11 of the drive device to provide the movements of drawing together and apart of the conveyance units 3. In this manner the position of the detecting member 44 is made dependent upon the width of the box as will be clarified below.

Lastly, the machine illustrated in the drawings includes along the box-supporting table four detecting levers 70, 71, 100 and 72 which detect the state of travel of the box and act on respective compressed air valves in such a manner as to create a predetermined sequence of operations of the various devices described. A stop rung 74 operated by a compressed air cylinder 75 is placed before the lever 71 to act as a positioning element for the box at the beginning of the closing cycle. A valve 200 attached to the bottom of the column 15 cooperates with a rod 150 attached in an adjustable position to the closing assembly 21 to establish a maximum height for said closing group 21.

A suitable compressed air control circuit for the various functions of the machine is illustrated in FIG. 16 and comprises the compressed air cylinder 34 for control of the closing device for the end flaps 23, the control cylinder 6 for drawing together and apart of the conveyance units 3, the control cylinder 75 for the stop rung 74, a control cylinder 101 for the brake clamps 41, a control cylinder 102 for the clutch placed between the motor 4 and the conveyance units 3, the cylinder 60 for control of the blocking head 59 (or a substitute member) associated with the detecting member 44, a cylinder 103 for lifting the closing assembly 21 and the limited travel cylinders 69 assigned to correction of the height of the closing assembly 21.

The control circuit of FIG. 16 also includes four valves 104, 105, 106 and 107 operated by the detecting levers 70, 71, 100 and 72, the aforementioned maximum height valve 200, the aforementioned valve 56 for detecting the rotation of the drum 49 associated with the detecting member 48, the valves 79 for detecting engagement of the conveyance units 3 with the sides of the boxes, the valve 73 for control of the cylinders 69 and a valve 110 controlled by an emergency pushbutton (not shown) capable of causing immediate opening of the machine if necessary.

Finally, there are provided some distributors indicated by numbers 121–129, a pressure regulator 130, two flow regulators 131 associated with the cylinders 69 and two 3-way connecting elements 132 and 133 (each with a check valve 134, 135 on one of the ways) with the second of which is associated a pressure regulator 136.

The control circuit of FIG. 16 in combination with the structure described in FIGS. 1–15 brings about the following type of operation. With the machine in the neutral position shown in FIG. 1, i.e. with the closing assembly 21 in the highest position, with the device 23 rotated as shown in FIG. 1 and with the detecting member 44 in the raised neutral position adjustable by means of the screw 47 (positions illustrated in solid lines and in dot and dash lines in FIG. 4) the boxes 80 are fed manually or mechanically onto the bed 1 with all the top flaps open as shown in FIG. 8. In this and the following figures the side flaps are indicated by number 81, number 84 indicates the bottom of the box, number 85 indicates the front wall thereof, number 86 indicates the rear wall thereof, and number 87 indicates the sides thereof. The direction of travel of the box is from right to left when viewing FIGS. 8–15.

The closing cycle starts when the bottom of the advancing box after pressing the lever 70 without causing changes of state reaches the positioning rung 74 and simultaneously presses the lever 71 (FIG. 8). The valve 105 then commutates (FIG. 16) which causes commutation of the distributor 122 into a position such as to allow the cylinder 6 to drive through the sliding body 7, the sector gears 9, the pins 10 and the swinging arms 11 the approacing of the conveyance units 3 until they engage the sides of the box (FIG. 12). In this situation a pair of vertical columns 90 (FIGS. 1 and 4) fixed on the conveyance units 3 holds the side flaps 83 of the box in the vertical position preventing outward spreading thereof. This condition is maintained to allow correct detection of the total height of the box with the side flaps open in accordance with the procedures explained below.

Simultaneously through the mechanical transmission formed by the gears 68 and 66, the chain 67, the telescopic shaft 65 and the bevel gear pair 63, 62, the rotation of the sector gears 9 is transmitted to the shaft 51 (FIGS. 5–7) which causes integral rotation of the disc 53 and of the drum 49 and then that of the interconnected supports 48 and 45 in the direction of lowering of the detecting bar 44. The transmission ratio and the initial adjustment of the screw 47 are selected in such a manner that in its final position the bar 44 is at a distance vertically from the base of the flap-pressing section 38 equal to half the width of the box which is in turn equal to the width of the side flap 8, i.e. to their height in the open position. Said position is illustrated in FIG. 8.

Engagement of the conveyance units 3 with the sides of the box is detected by the compressed air valves 79 (FIGS. 2 and 3) which through Ccommutation of the distributors 123 and 128 control raising of the stop rung 74 and deactivation of the raising cylinder 103 of the closing assembly 21 to allow the resulting fall by gravity of said rung assembly.

The fall stops when the detecting member 44 rests upon the nearest open side flap of the box (FIG. 9) causing thereby a small rotation of the support 45, 48 and of the turning drum 49 relative to the fixed disc 53 and the shaft 51. Said rotation is detected through the notch 58 of the compressed air valve 56 (FIGS. 5 and 6) which controls the action of the cylinder 60 for advancement of the rung 59 until it engages in a blocking manner with the cylindrical wall of the drum 49 (or for limited lifting of the detecting member (44) and also controls through the cylinder 101 the action of the brake clamps 41 for stopping the fall of the closing assembly 21 and through the cylinder 102 that of the clutch associated with the motor assembly 4 for operation of the conveyance belts of the units 3.

In consideration of the previous setting of the detecting member 44 at a distance from the base of the section 38 equal to the height of the open side flaps and of the detection now executed by said member 44 of the total height of the box with open flaps, stopping of the fall of the closing assembly 21 takes place in such a position that the distance between the raised front end of the base of the section 38 and hence of said closing assembly 21 and the box-supporting table is exactly equal to or slightly greater than the actual height of the box with end flaps closed.

In this manner while the closing assembly 21 stops in the position shown in FIG. 9, slightly compressing the springs 43 to then be pushed back thereby into the correct position, the front or inlet end of the flap-holding device 25 is in a position such as to allow entry of the box, which is drawn forward by the conveyance units 3, which are now motor driven. The stop rung 74 has meanwhile been made to return within the space occupied by the bed 1.

From this moment onward there begins the cycle of closing of the top flaps of the box the performance of which depends on the length of the box. If the box is short as shown in FIGS. 8-13 said box advances freely until it encounters the lever 100 after abandoning the lever 70. Consequently first the front flap 81 engages the bars 27 and is overturned thereby into the closed position and then, at the moment of the engagement with the lever 100 (FIGS. 10 and 13) and the consequent commutation of the valve 106, the cylinder 102 is returned to neutral for the release of the clutch device controlling the conveyance units 3 and the resulting momentary stopping of the travel of the box and the cylinder 34 controlling the closing device 23 is activated for closing of the rear flaps 82 of the box. More precisely, the cylinder 34 causes rotation of the disc support 29 in such a manner that the extension 31 causes an initial closing overturn of the rear flap 82 and then the blade 33, rotating by reaction of a fixed-length tape in accordance with the operations explained in the aforementiond Italian patent application No. 21011 B/85 filed Mar. 6, 1985, completes closing of said flap (FIG. 10).

If the box is long as shown in FIGS. 14 and 15 the front flap 81 is still closed in conformity with the preceding process but control of the rear-flap closing device is provided not by the encounter of the box with the lever 100 but by abandonment of the lever 70 with the lever 100 already pressed. Abandonment of the lever 70 then causes, thanks to the distributors 125 and 121 and the cylinders 102 and 34, momentary disengagement of the clutch which controls the conveyance units 3 and activation of the rear-flap closing device 82 (FIGS. 14 and 15).

In this manner interference of the closing blade 33 with the front flap of the box with the resulting obstruction of the closing of the latter or of correct operation of said closing blade is always prevented.

When the closing operation of the end flaps 81 and 82 has been performed in the manner described, after a period of time determined by the distributor 127, the conveyance units 3 are again started and the box consequently enters under the inlet end of the section 38 which is superimposed accurately on the front flap 81, holding it in the closing position. Continuing to advance the box pushes progressively upward the following portions of the section 38 which rotates around the pin 76 to the horizontal position (FIG. 11).

When said position is reached the valve 73 causes through the cylinders 69 very limited lifting of the closing assembly 21 which lightens if necessary the pressure on the top of the box aided therein by the springs 43 upon which the closing asembly is floating. This prevents possible jamming and damage to the box. On this occasion the flow regulators 131 prevent excessively high adjusting jumps.

As the box continues its travel, while the base of the section 38 is superimposed also on the rear flap 82 of the box, holding it in the closed position, the two screws 24 engage the side flaps 83 to cause progressive closing rotation thereof. Meanwhile the device 23 has returned to the position shown in FIG. 1 driven in said direction by the cylinder 34 following release of the lever 71.

With the side flaps 83 closed on the end flaps 81 and 82 the box then passes under the taping unit 26 which applies a strip of sealing adhesive tape along the longitudinal central fissure which separates the two folded side flaps.

The cycle terminates when the box 80 encounters and then abandons the lever 72. Release of the latter causes withdrawal again of the conveyance units 3, lifting again of the closing assembly 21, release of the drum 49 and deactivation of the clutch associated with the motor assembly 4. The machine then returns to the neutral position.

The valve 200 together with the rod 150 has the purpose of limiting the working height of the machine when the boxes do not require maximum height. Furthermore, it has the purpose of limiting the supporting pressure of the closing assembly 21 and permitting an immediate response to the command to fall.

I claim:

1. Self-adjusting closing machine for parallel-eqiped boxes of varying format comprising a box-supporting table, a pair of belt conveyance units extending along opposite sides of said box-supporting table, means for drawing together said conveyance units until they engage the corresponding opposite sides of the boxes, a closing assembly for the top flaps of the boxes adjustable at variable height above said box-supporting table and adjusting means to automatically adjust said variable height of the closing assembly on the basis of the format of the boxes characterized in that said adjusting means comprise a detecting member to measure the height of the box with side flaps open mounted in a vertically variable position on said closing assembly, means for modifying the vertical position of said detecting member relative to a lifted neutral position, a mechanical transmission with predetermined ratio placed between said means to draw together the conveyance units and said means for modifying the vertical position of said detection member in such a manner as the preset said detecting member in a lowered position the distance of which from the base of said closing assembly is equal to half the width of the box, first sensitive means which respond to the engagement of said conveyance units with the sides of said box in such a manner as to control descent of said closing assembly from a raised neutral position to a miximum height above the supporting table, means for braking said closing assembly, second sensitive means which respond to the engagement of said detecting member with the top of an open side flap of the box in such a manner as to control operation of said braking means to stop descent of said closing assembly at a height equal to the difference between the detected height of the box with open side flap and half the width of the box and activation of said conveyance units for further advancement of the box, and third sensitive means which respond to said further advancement of the box to control operation of said closing assembly for closing of the rear flap of the box.

2. Machine in accordance with claim 1 characterized in that said mechanical transmission with predetermined ratio is the geared type.

3. Machine in accordance with claim 1 characterized in that said detecting member consists of a bar born by a support fixed to a turning drum stressed in a predetermined angular position in relation to a coaxial shaft supported by said closing assembly and caused to rotate through said mechanical transmission.

4. Machine in accordance with claim 3 characterized in that said support of the detecting member is made in two parts with adjustable angle.

5. Machine in accordance with claim 3 characterized in that said second sensitive means consist of at least one valve member made integral with said shaft and cooperating with said drum to detect rotation thereof relative to said shaft.

6. Machine in accordance with claim 3 characterized in that said mechanical transmission comprises a vertical telescopic shaft connecting said supporting table and said closing assembly, a pair of gears placed between the upper end of said telescopic shaft and said shaft, and a gear & chain transmission placed between the lower end of said telescopic shaft and said means to draw together the conveyance units.

7. Machine in accordance with claim 6 characterized in that said means for drawing together the conveyance units comprise a drive cylinder, a sliding body with opposite sides in the form of a rack driven by said cylinder, a pair of sector gears engaged with said rack sides of the sliding body, a pair of rotation pins for said sector gears and a pair of swinging arms made integral with said sector gears through said rotation pins, and said gear and chain transmission comprises a gear mounted on the lower end of said telescopic shaft, another pair of gears mounted on said rotation pins and a chain connecting said gears.

8. Machine in accordance with claim 1 characterized in that said braking means consist of at least one braking clamp born by said supporting table and cooperating with a vertical rod connected with said closing assembly.

9. Machine in accordance with claim 8 characterized in that it comprises at least one spring placed between said vertical rod and said closing assembly to provide sprung support for said closing assembly.

10. Machine in accordance with claim 1 characterized in that said third sensitive means comprise a first and a second sensitive element arranged along said supporting table in such a manner as to be encountered in succession by the advancing box, said sensitive elements being operationally connected together and with said closing assembly in such a manner that operation of said closing assembly to close the rear flap of the box is caused alternatively by abandonment of the first sensitive element if the box has already encountered the second sensitive element or by encounter with the second sensitive element if the first sensitive element has been abandoned before the box has encountered the second sensitive element.

11. Machine in accordance with claim 1 characterized in that said third sensitive means also cause momentary stopping of said conveyance units during the closing time of the rear flap of the box.

12. Machine in accordance with claim 1 characterized in that said base of the closing assembly is provided by a flap-holding section with overturned T cross section attached to said closing assembly in such a manner as to develop in the longitudinal direction of the machine in an inclined position at a height decreasing from the inlet end of the boxes to the outlet end of the boxes and can also take a horizontal position during passage of a box under said section.

13. Machine in accordance with claim 12 characterized in that it comprises fourth sensitive means which respond to the arrangement of said section in a neutral position and at least one limited-travel cylinder placed between said supporting table and said closing assembly and controllable by said fourth sensitive means to cause a small raising of said closing assembly relative to the stop position created by said braking means.

14. Machine in accordance with claim 1 characterized in that it comprises columns fixed on said conveyance units to hold in a vertical position the side flaps of the box during the fall of said closing assembly.

* * * * *